US012369738B2

(12) United States Patent
Bing et al.

(10) Patent No.: US 12,369,738 B2
(45) Date of Patent: Jul. 29, 2025

(54) HEIGHT ADJUSTABLE HOSPITAL CURTAIN

(71) Applicant: Cintas Corporate Services, Inc., Cincinnati, OH (US)

(72) Inventors: Richard R. Bing, West Chester, OH (US); Bryan J. Colpo, Cincinnati, OH (US); Shawn K. King, Mason, OH (US); David Steven Mesko, Wyoming, OH (US); Amy E. Wilker, Bellevue, KY (US); Michael Komatz, Ny, NY (US); Adem Önalan, Istanbul (TR); Marco Perry, Brooklyn, NY (US); Brooke Williams, New York, NY (US)

(73) Assignee: Cintas Corporate Services, Inc., Cincinnati, OH (US)

( * ) Notice: Subject to any disclaimer, the term of this patent is extended or adjusted under 35 U.S.C. 154(b) by 340 days.

(21) Appl. No.: 17/982,602

(22) Filed: Nov. 8, 2022

(65) Prior Publication Data

US 2023/0329470 A1 Oct. 19, 2023

Related U.S. Application Data

(60) Provisional application No. 63/320,369, filed on Mar. 16, 2022, provisional application No. 63/320,366,
(Continued)

(51) Int. Cl.
*A47H 1/04* (2006.01)
*A47H 13/00* (2006.01)
(Continued)

(52) U.S. Cl.
CPC ..... *A47H 23/04* (2013.01); *A47H 1/04* (2013.01); *A47H 13/00* (2013.01); *A47H 23/02* (2013.01);
(Continued)

(58) Field of Classification Search
CPC ..... A47H 15/00; A47H 15/02; A47H 15/04; A47H 7/02; A47H 23/02; A47H 2023/025;
(Continued)

(56) References Cited

U.S. PATENT DOCUMENTS 588,454 A * 8/1897 Lloyd ..... A47H 5/14 248/257
708,381 A * 9/1902 Miller ..... A47H 5/14 160/339
(Continued)

*Primary Examiner* — Johnnie A. Shablack
(74) *Attorney, Agent, or Firm* — Frost Brown Todd LLP

(57) ABSTRACT

A curtain is suitable for use in a hospital, patient facilities or surgical setting. The curtain is slideably attached along a ceiling track. A top edge of the curtain may be attached to the ceiling track by a number of pulleys each of which may be utilized to lower the top edge of curtain to a height which is conveniently accessible to someone standing on the floor of the room to remove and/or replace the curtain. In some embodiments of this invention, the curtain has a top portion joined to a bottom portion by a zipper. The pulleys lower the curtain for someone to easily access the zipper to remove, replace and/or attach the bottom portion from/to the top portion. In other embodiments, the pulleys lower the entire curtain for removal and replacement.

16 Claims, 19 Drawing Sheets

Related U.S. Application Data filed on Mar. 16, 2022, provisional application No. 63/317,112, filed on Mar. 7, 2022, provisional application No. 63/304,833, filed on Jan. 31, 2022, provisional application No. 63/280,651, filed on Nov. 18, 2021.

(51) Int. Cl.
*A47H 23/02* (2006.01)
*A47H 23/04* (2006.01)

(52) U.S. Cl.
CPC .... *A47H 2001/045* (2013.01); *A47H 2201/00* (2013.01)

(58) Field of Classification Search
CPC ..... A47H 2201/00; A01G 9/22; A01G 9/227; A47K 3/38
See application file for complete search history.

(56) References Cited

U.S. PATENT DOCUMENTS 1,413,846 A * 4/1922 Fredak ..... A47H 7/02 242/380
1,447,149 A * 2/1923 Pfeiffer ..... A47H 7/02 211/103
1,809,109 A * 6/1931 Clark ..... A47H 5/14 160/339
2,273,426 A * 2/1942 Washburn ..... A47H 5/00 160/344
2,375,457 A * 5/1945 Woodward ..... A47H 5/14 160/125
2,654,486 A * 10/1953 Lundkvist ..... A47H 7/02 160/338
3,120,895 A * 2/1964 Mahana ..... A47H 7/02 160/125
3,416,672 A * 12/1968 Kohaut ..... A47H 7/02 211/103
3,777,314 A 12/1973 Boser
3,968,523 A 7/1976 Newman
4,606,527 A * 8/1986 Ziller ..... A63J 1/028 472/78
4,693,291 A 9/1987 Andrews
4,996,933 A 3/1991 Boser
5,217,057 A * 6/1993 Hubbard ..... A47H 13/04 160/123
5,240,758 A 8/1993 Honigberg
5,410,975 A 5/1995 Dudek et al.
6,192,965 B1 2/2001 Hinds
6,394,168 B1 5/2002 Zoboski
7,350,244 B1 4/2008 Handley
7,909,082 B2 3/2011 Peoples
8,464,365 B1 6/2013 Nunn et al.
8,500,188 B2 8/2013 Huotari et al.
9,204,749 B1 12/2015 Trapani
9,661,947 B2 5/2017 Mayer
10,973,356 B2 * 4/2021 Choi ..... A47H 1/142
10,975,605 B2 * 4/2021 Hamilton ..... E06B 9/00
11,944,227 B1 * 4/2024 Green ..... A47H 5/14
2006/0026747 A1 2/2006 Prabhakar
2007/0261803 A1 11/2007 Alexander et al.
2007/0284058 A1 12/2007 Peoples
2012/0222826 A1 9/2012 Foss et al.
2013/0205548 A1 8/2013 Wehner
2014/0209255 A1 * 7/2014 Degiovanni ..... A47H 7/02 160/84.01
2019/0000240 A1 1/2019 Rabbany et al.
2022/0007872 A1 1/2022 Stern
2023/0148778 A1 * 5/2023 Bing ..... A47H 13/00 160/341
2023/0148779 A1 5/2023 Bing et al.
2023/0329470 A1 * 10/2023 Bing ..... A47H 1/04
2023/0404298 A1 * 12/2023 Blase ..... E04B 1/8218

* cited by examiner

HEIGHT ADJUSTABLE HOSPITAL CURTAIN

This claims the benefit of U.S. Provisional Patent Application Ser. No. 63/280,651, filed Nov. 18, 2021; Ser. No. 63/304,833, filed Jan. 31, 2022; Ser. No. 63/317,112, filed Mar. 7, 2022; Ser. No. 63/320,369, filed Mar. 16, 2022; and Ser. No. 63/320,366, filed Mar. 16, 2022, each of which is hereby incorporated by reference in its entirety.

BACKGROUND

This invention relates generally to curtains and, more specifically, the invention relates to a detachable, ventilating enclosure for use with a supporting structure or railing to provide an enclosure of the type utilized for hospital settings, surgical facilities, or the like.

Curtains are often used to divide larger hospital rooms into individual patient or examination areas. They are useful in providing a patient with his or her own private area when other patients are in the room or to provide privacy in higher traffic settings in a hospital, clinic or other healthcare facility, such as an emergency room or post-operative recovery room. Often, the curtains are attached by hooks or other means that are slidably mounted to curtain tracks attached to the ceiling of the hospital room or other healthcare facility. The slidable mounting makes it convenient for the curtains to be moved back and forth between open and closed positions so that a health care professional, visitor, or the patient may enter and exit the area with ease.

Typically, hospital curtains are made from cloth or a cloth-like material. Due to the fibrous nature of this type of material, the curtains often become a haven for bacteria and microbial growth. Bacteria and germs are transmitted to and from the curtains through the air or by physical contact. Moreover, the process of installing a new or washed and cleaned curtain may result in the curtain contacting the floor and attracting contaminants and unwanted particles that might be present on the floor.

Such curtains in the prior art are expensive to manufacture, difficult to launder, and increase the risk of infection. One noted problem is that removal of prior curtains for cleaning often requires the individual removing the curtain to stand on a chair or similar piece of furniture to reach the top of the curtain and detach the curtain from the ceiling mounted rail or support mechanism. Replacement of a curtain has a similar problem. This can be dangerous both to the individual doing the removing and any patient nearby. Use of a chair or ladder may be required to adequately access and remove/install the curtain. This can be potentially dangerous if the person falls from the chair or ladder and, at the least, is time consuming and cumbersome, especially if dozens of curtains are being removed and reinstalled at a time.

It is known in the art to make a bottom portion of the curtain separable from the top portion as shown in U.S. Pat. No. 9,204,749, which is hereby incorporated by reference in its entirety. In the invention disclosed in the '749 patent, the hospital curtain is made up of a ventilated top portion attached by curtain carriers and eyelets to a ceiling mounted curtain track, and a bottom portion joined to a bottom edge of the top portion by a zipper for selective removal of the bottom portion for washing or replacement. However, the zipper is often located at a height well above the floor of the room and is difficult for most service personnel to easily unzip or zip the bottom portion from/to the top portion without the benefit of a ladder, step stool or other device.

Accordingly, what is needed is an improved hospital curtain that can be easily and safely removed and replaced without the need for a ladder or other assisting device to remove and replace the curtain.

The above and other objects and advantages in accordance with the principles of this invention shall be made apparent from the accompanying drawings and the description thereof.

SUMMARY OF THE INVENTION

This invention overcomes these and other shortcomings of the prior art by providing a hospital curtain slideably attached along a ceiling track. A top edge of the curtain may be attached to the ceiling track by a number of pulleys each of which may be utilized to lower the top edge of curtain to a height which is conveniently accessible to someone standing on the floor of the room to remove and/or replace the curtain.

In some embodiments of this invention, the curtain has a top portion joined to a bottom portion by a zipper. The pulleys lower the curtain for someone to easily access the zipper to remove, replace and/or attach the bottom portion from/to the top portion. In other embodiments, the pulleys lower the entire curtain for removal and replacement.

The top portion may be solid, or include a mesh or mesh-like fabric or substance. The top portion may be constructed so as to allow air and/or light to pass through. The bottom portion may be opaque so as to provide privacy, and may be manufactured from a variety of materials known to the industry, including but not limited to polypropylene, polyester, treated natural fibers, or other fabrics. The curtain material may be flame resistant and/or antibacterial. The bottom portion may be single-use or disposable, or may be reusable. In one exemplary embodiment, the bottom portion is manufactured from sturdy material able to withstand frequent washings or cleanings. Once removed from the top portion, the bottom portion may be discarded or laundered and re-installed on the same or a different top portion. Once the bottom portion is removed from the top portion, a different and clean bottom portion may be installed onto the top portion.

Easy removal and replacement of the bottom portion or the entire curtain for cleaning and other purposes is thereby promoted by embodiments of this invention. Once removed, the bottom portion or entire curtain may be cleaned and re-installed. Alternatively, a different, new and/or clean bottom portion or entire curtain may be installed which may be part of a service providers role in the maintenance of the clinical setting and associated curtain installation.

Further areas of applicability of this invention will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
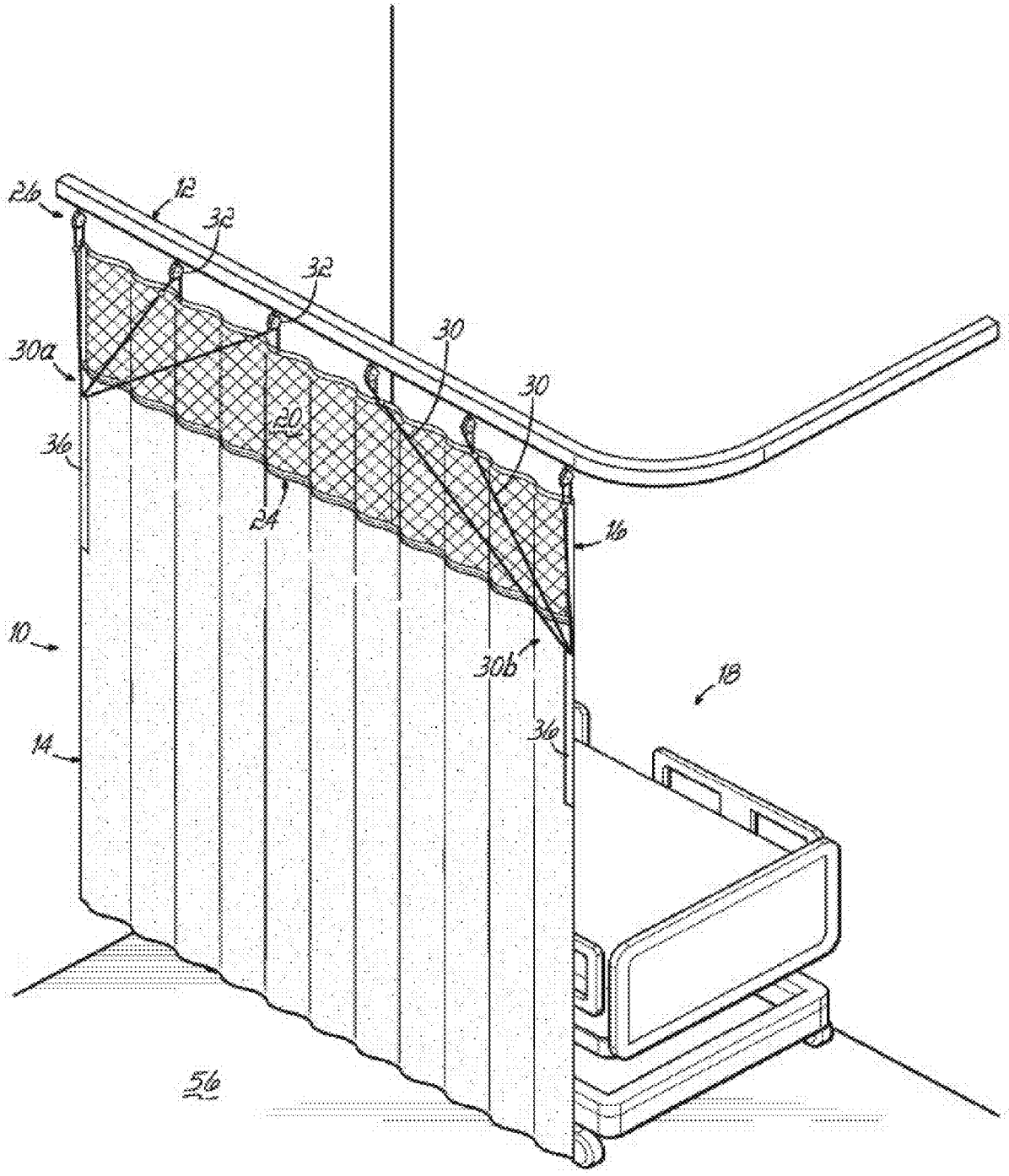
FIG. 1 is a perspective view of one embodiment of a curtain in a clinical setting according to this invention.

Turning now to the drawings, in which similar reference characters denote similar elements throughout the several views. With regard to the reference numerals used, the following numbering is used throughout the various drawing figures. The following discussion describes in detail at least one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of one embodiment of this invention being a curtain assembly 10 suspended from a track 12, showing a wide bottom portion 14 separable from a narrow top portion 16. The track 12 may be mounted to a ceiling atop an exam area 18 defined at least in part by the curtain assembly 10. In FIG. 1, the curtain 10 is shown in an operational height relative to the track 12 for movement along the track 12 to provide or inhibit access to clinical exam area 18 or another environment. The top portion 16 may have a top segment made of a mesh material 20 for ventilation and is slideably attached along the track 12 using a number of curtain carriers 26 coupled to spaced apart eyelets 22 on a top edge of the top portion 16. An attachment mechanism which in some embodiments is a zipper mechanism 24 extends between and selectively joins a top edge 14*a* of the bottom portion 14 to a bottom edge 16*a* of the top portion 16 of the hospital curtain 10. The zipper mechanism 24 is for selectively removing/attaching the bottom portion 14 from/to the top portion 16 of the hospital curtain 10 when desired.

As shown in FIGS. 1-6D, the curtain 10 is slidably attached to the track 12 by curtain hooks 28 each of which is looped through one of the eyelets 22. The curtain hooks 28 are suspended by a cord 30 which is attached to the end of the curtain hook 28 opposite from the eyelet 22. Each cord 30 passes upwardly through a rig which in one embodiment is a pulley 32 and then downwardly to be accessible to an operator. While the pulley 32 is shown and described herein, other rig mechanisms may be used within the scope of this invention. A free end or distal end portion 34 of the cord 30 at an end of the cord 30 opposite from the curtain hook 28 may be gathered with the distal end portion 34 of other cords 30 and tucked into a sleeve or pocket 36 on the curtain 10 to maintain them in order and avoid entanglement with each other or personnel proximate the exam area 18. A first set 30*a* of the cords 30 adjacent a first lateral end boa of the curtain 10 may be gathered together and inserted into a first sleeve 36*a* and a second set 30*b* of cords 30 proximate an opposite second lateral end bob of the curtain 10 may be gathered together and inserted into a second sleeve 36*b* as shown in FIG. 1.

Each pulley 32 may be suspended from the track 12 by a pulley hook 38 which is movable along the track 12 for repositioning, opening and closing the curtain 10. Each pulley hook 38 is coupled to a hanger 40 on the pulley 32. The hanger 40 of each pulley 32 is suspended between a pair of spaced plates 42 which sandwich therebetween a journal 44 which is mounted for rotation between the plates 42 about a pin 45. The journal 44 has a lower raceway 46 through which the cord 30 passes around the journal 44. An upper raceway 48 is also formed by the journal 44 between the plates 42. A fixed hub 49 is also mounted between the plates 42 of the pulley 32. The hub 49 has a downwardly oriented socket 50 formed in a distal end thereof. The socket 50 is sized and configured to receive therein either of two ball detents 52, 54 secured to the cord 30 at a spaced distance from one another as shown in FIGS. 6A-7D.

Figure 2:
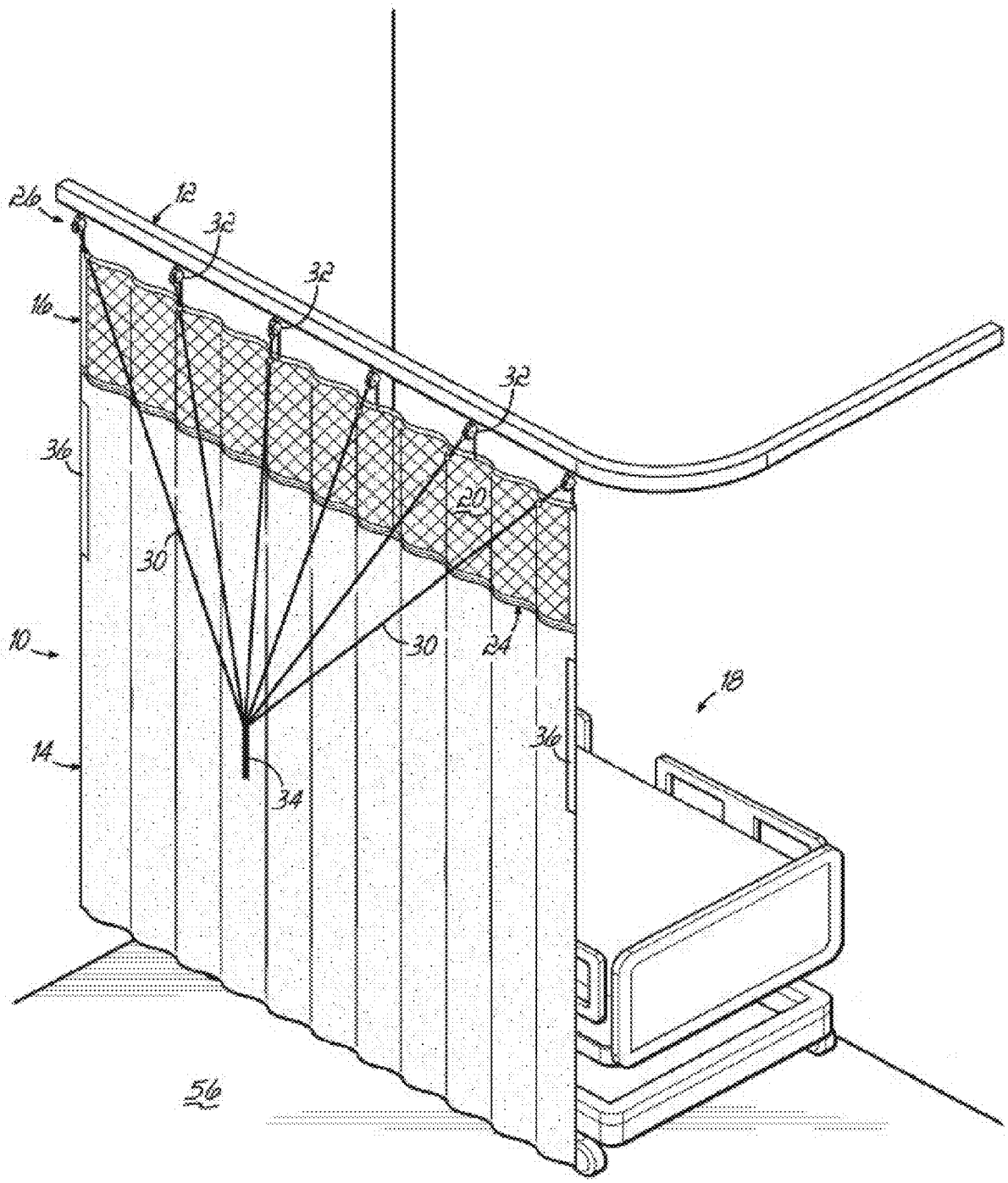
FIG. 2 is a view of the curtain of FIG. 1 with cords from pulleys gathered together.
Figure 3:
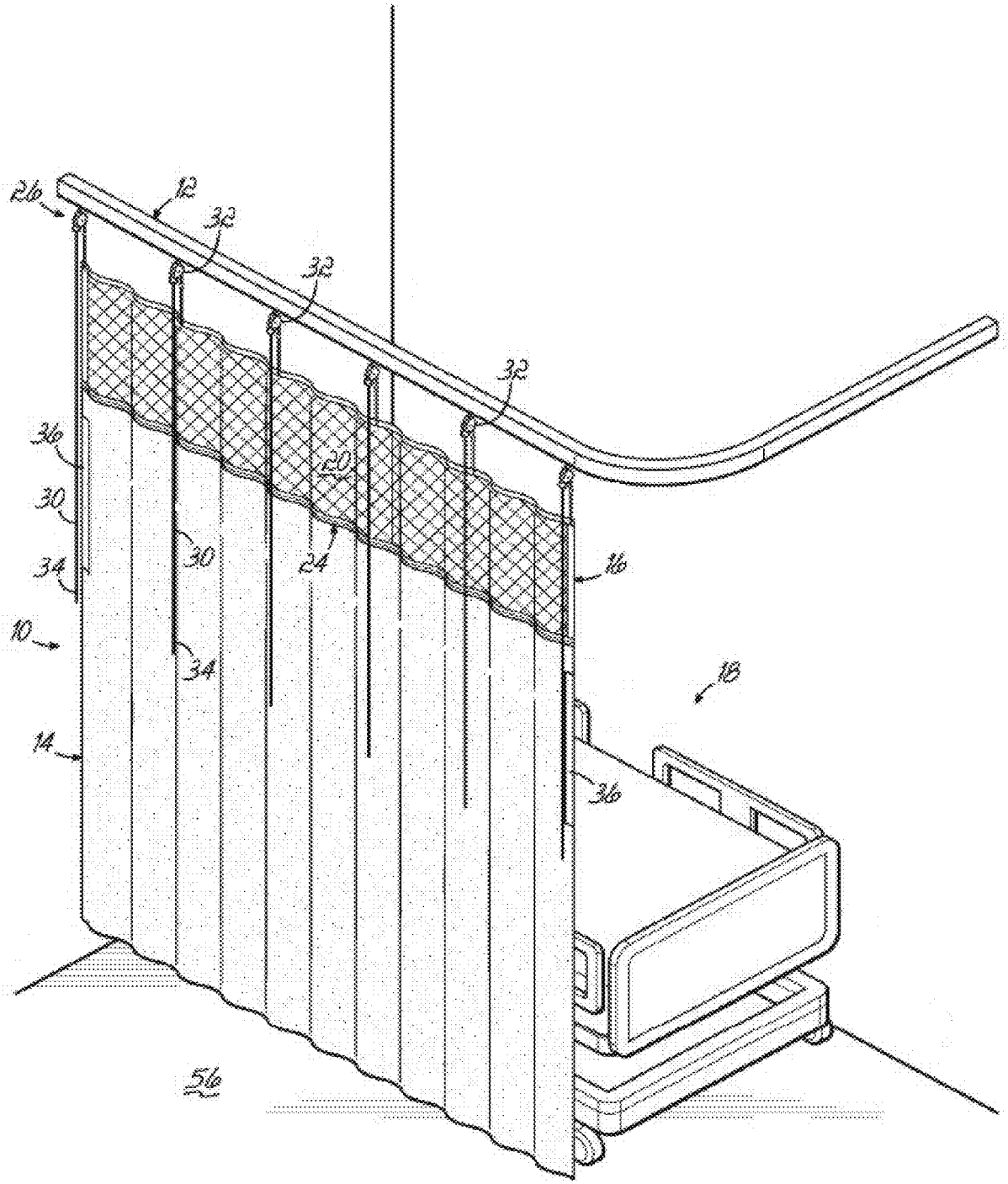
FIG. 3 is a view of the curtain of FIGS. 1 and 2 with the cords separated from one another.
Figure 4:
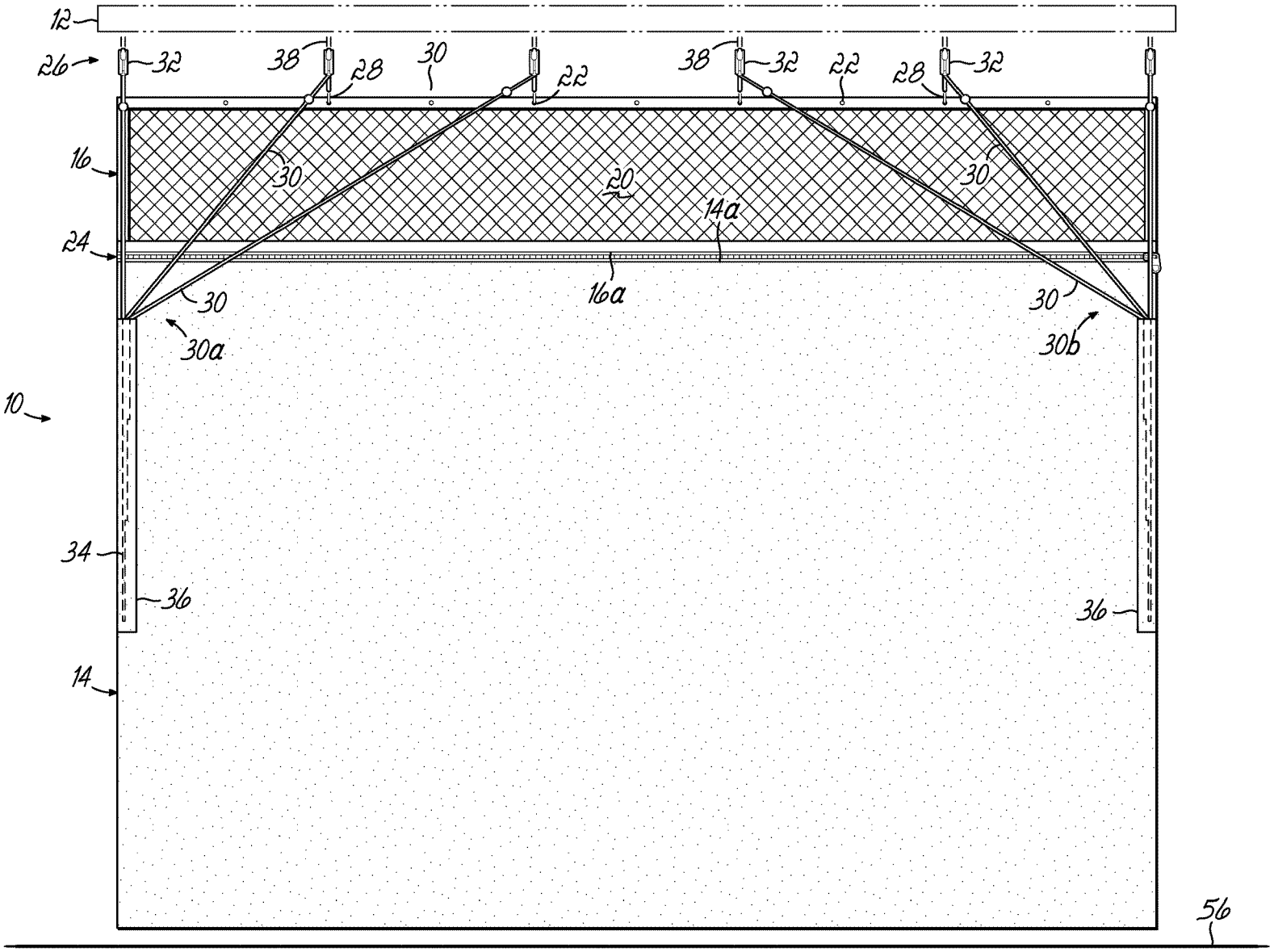
FIG. 4 is front elevational view of the curtain of FIGS. 1-3 with the cords tucked into one of two pockets in a lower portion of the curtain.
Figure 5:
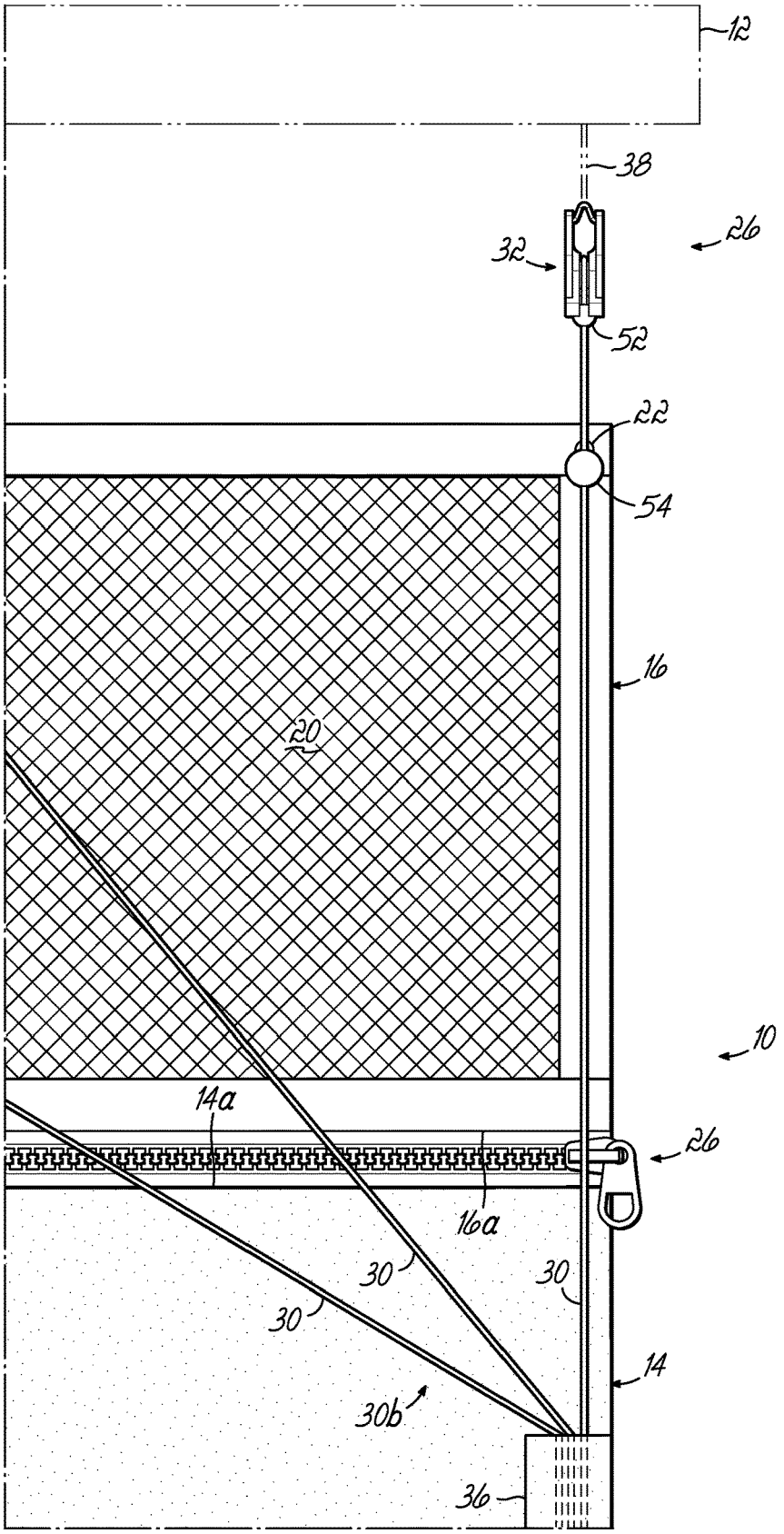
FIG. 5 is an enlarged view of a portion of the curtain of FIG. 4.
Figure 6A:
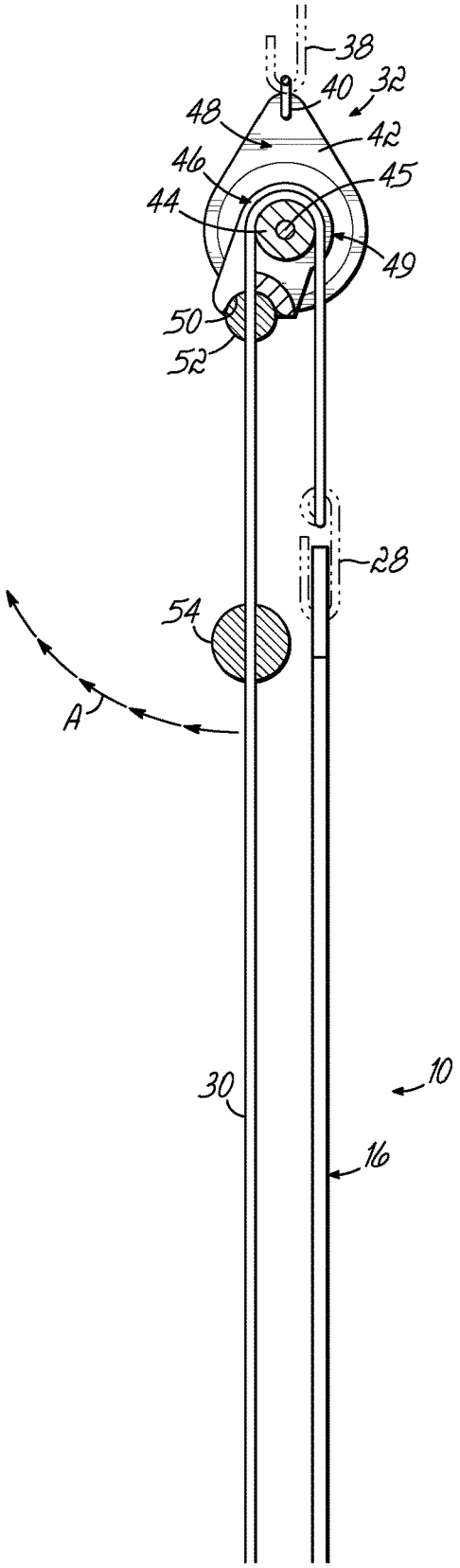
FIGS. 6A-6D are sequential cross-sectional side elevational views of a pulley according to one embodiment of this invention lowering the curtain.
Figure 6B:
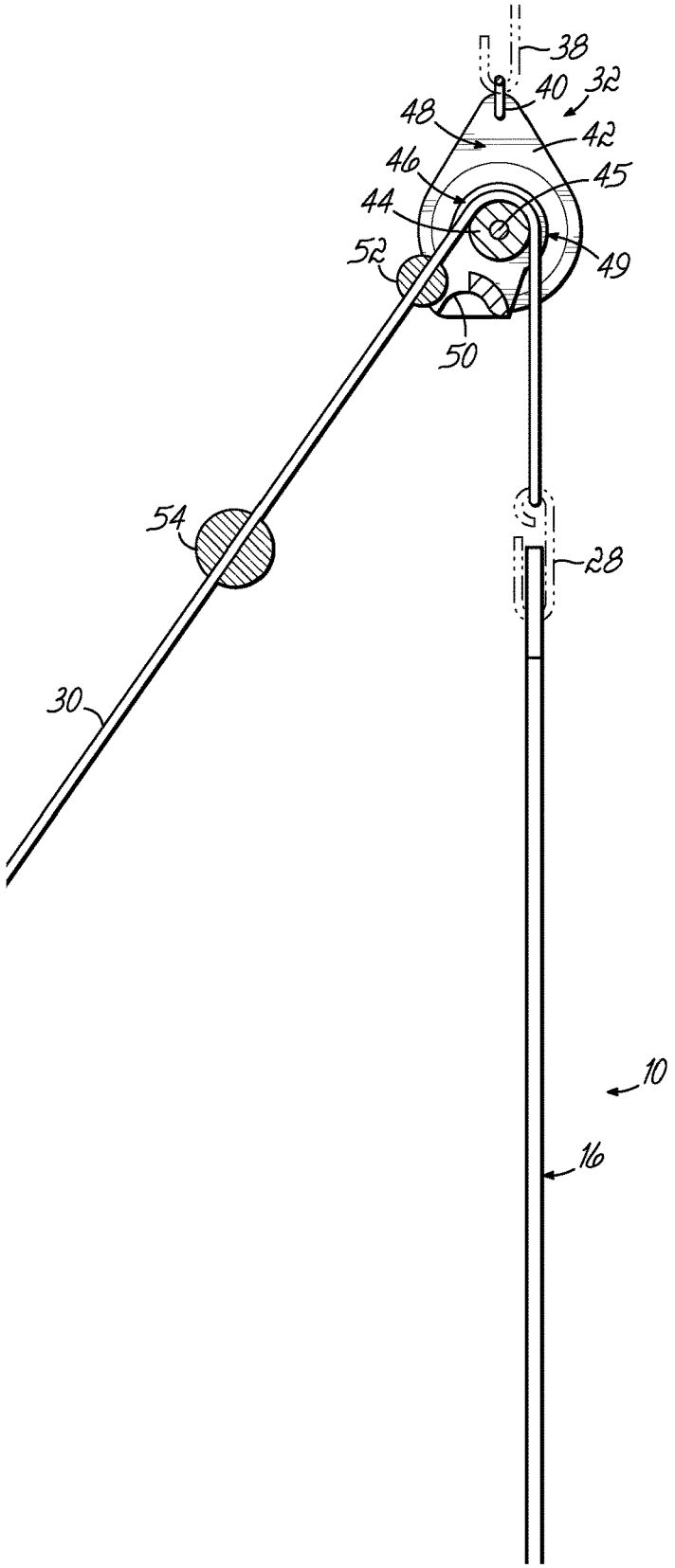
Figure 6C:
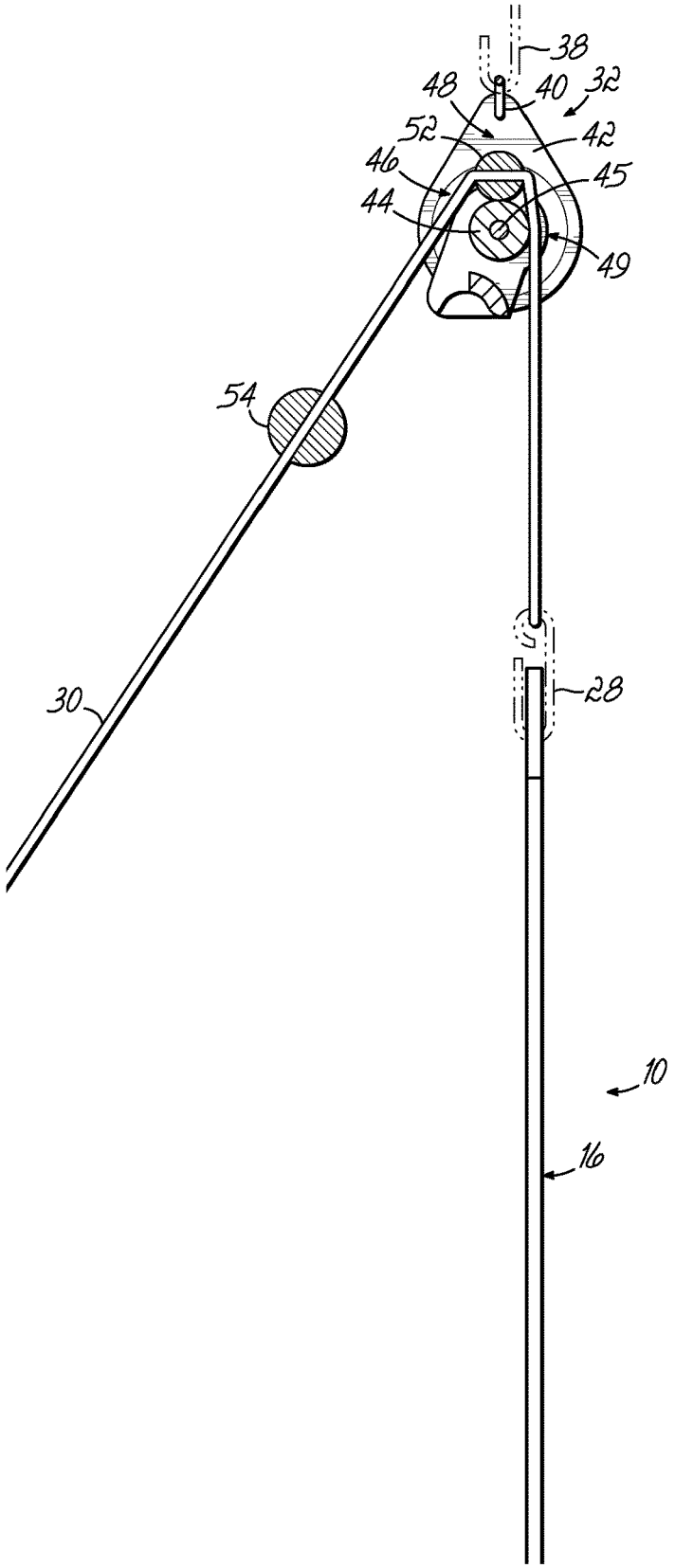
Figure 6D:
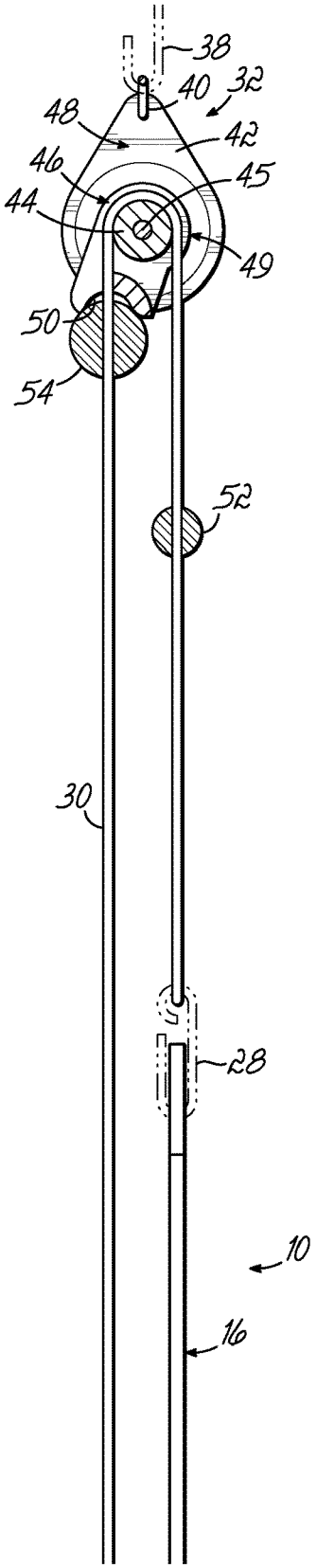
Figure 7A:
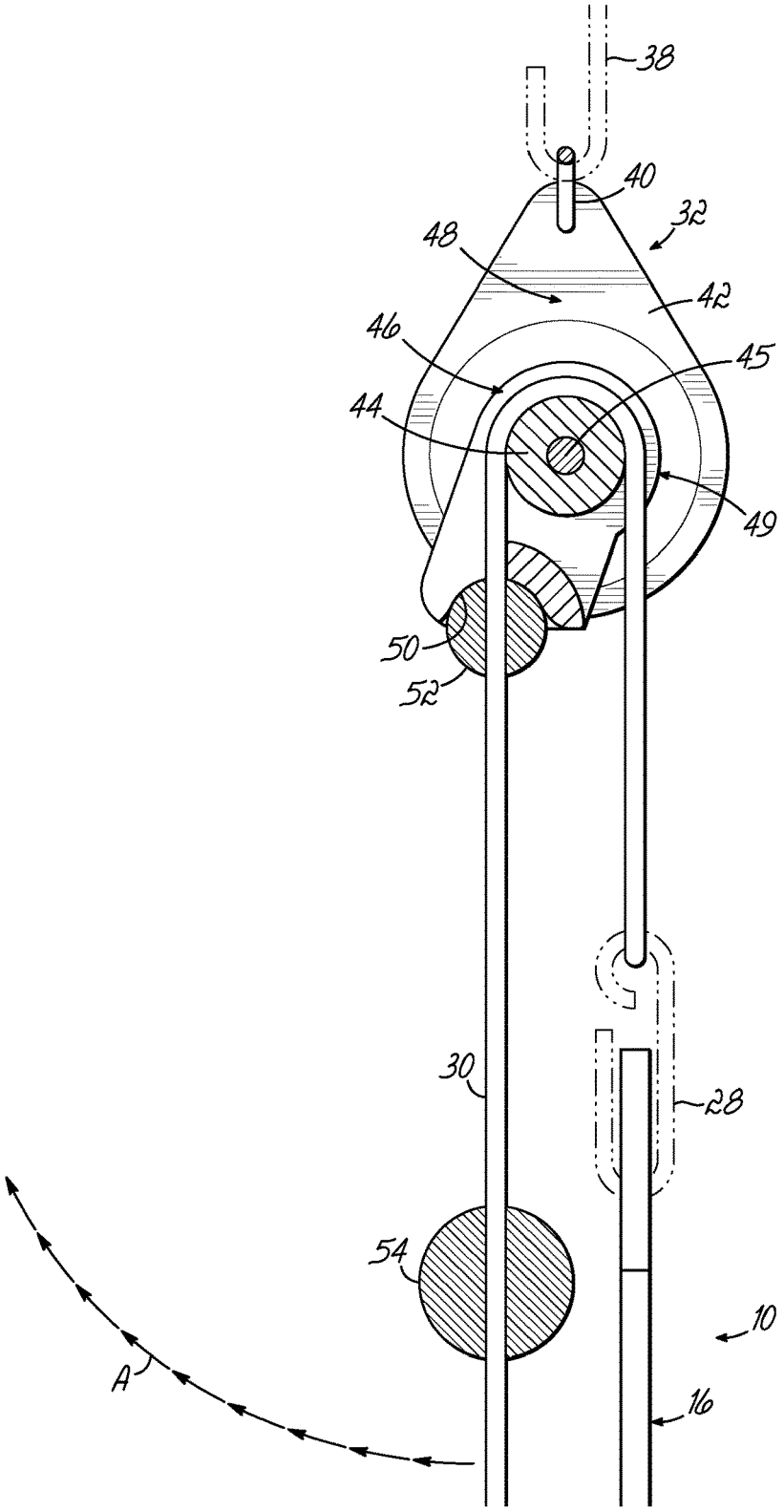
FIGS. 7A-7D are sequential cross-sectional side elevational more detailed views of a pulley according to one embodiment of this invention lowering the curtain.
Figure 7B:
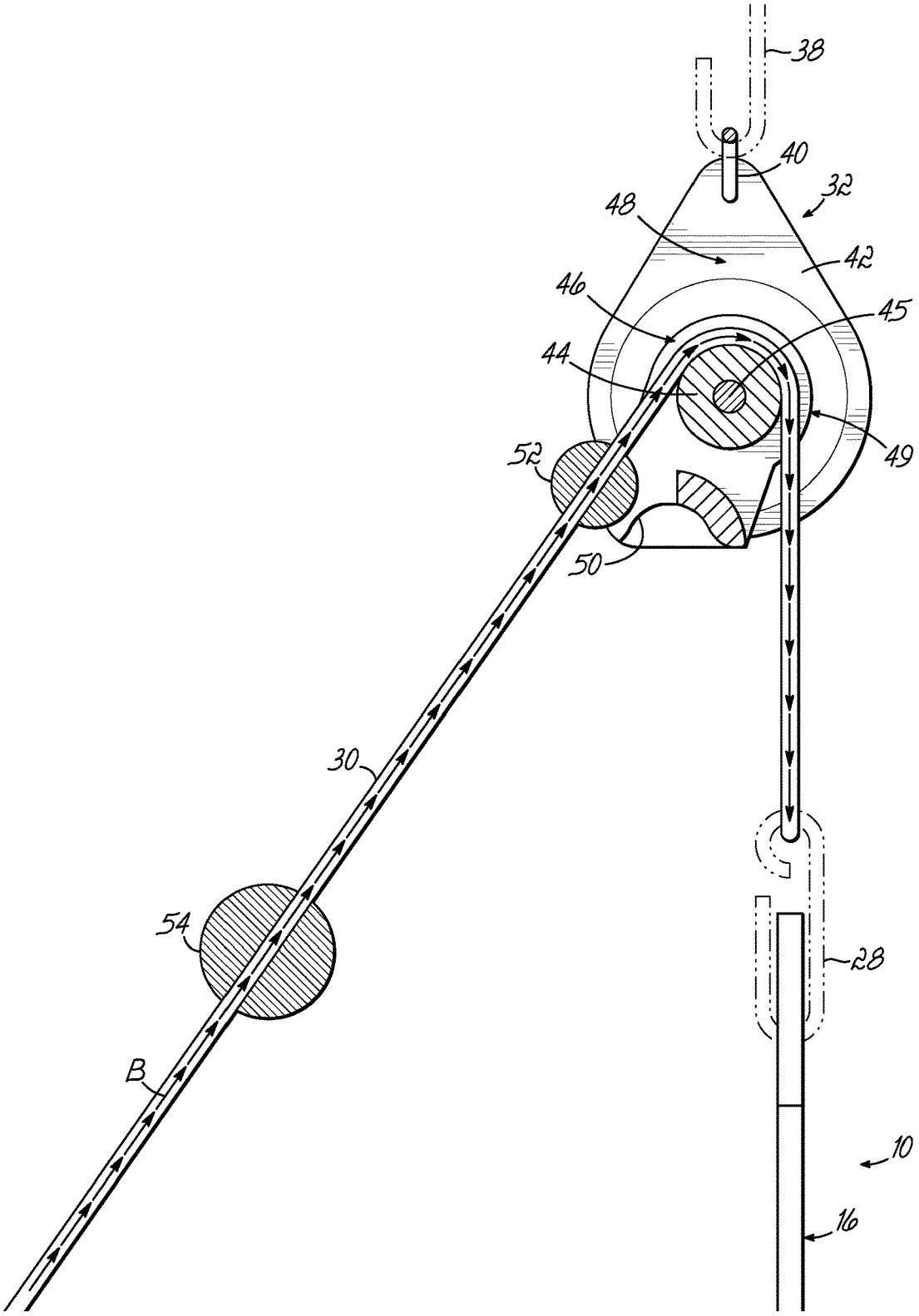
Figure 7C:
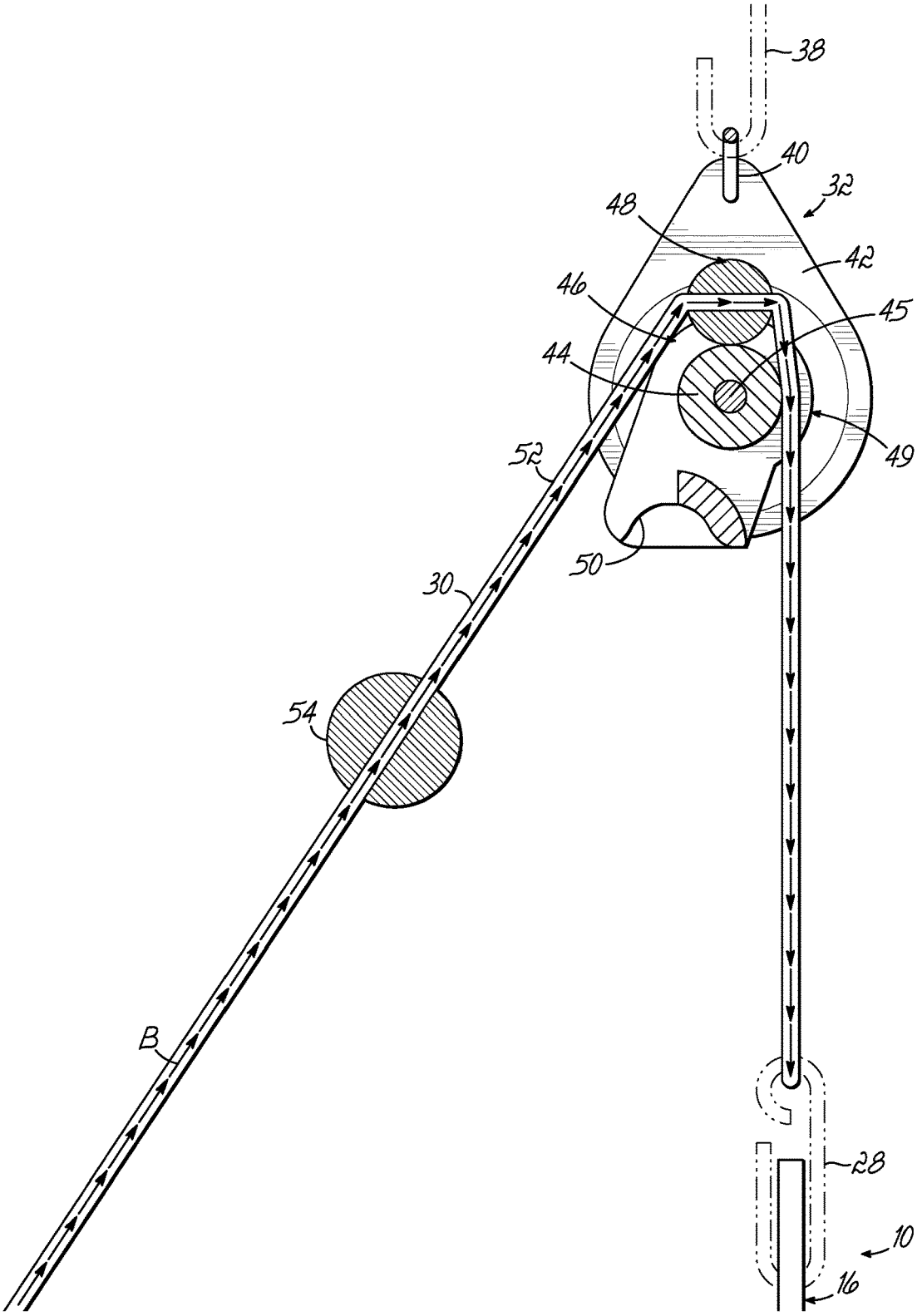
Figure 7D:
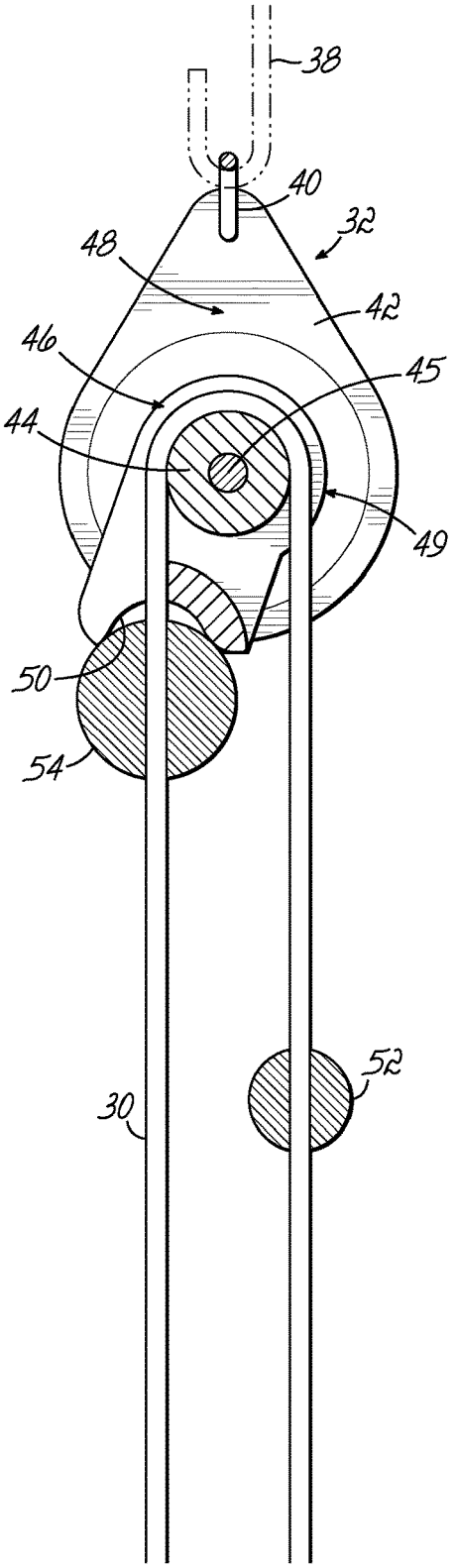
Figure 8A:
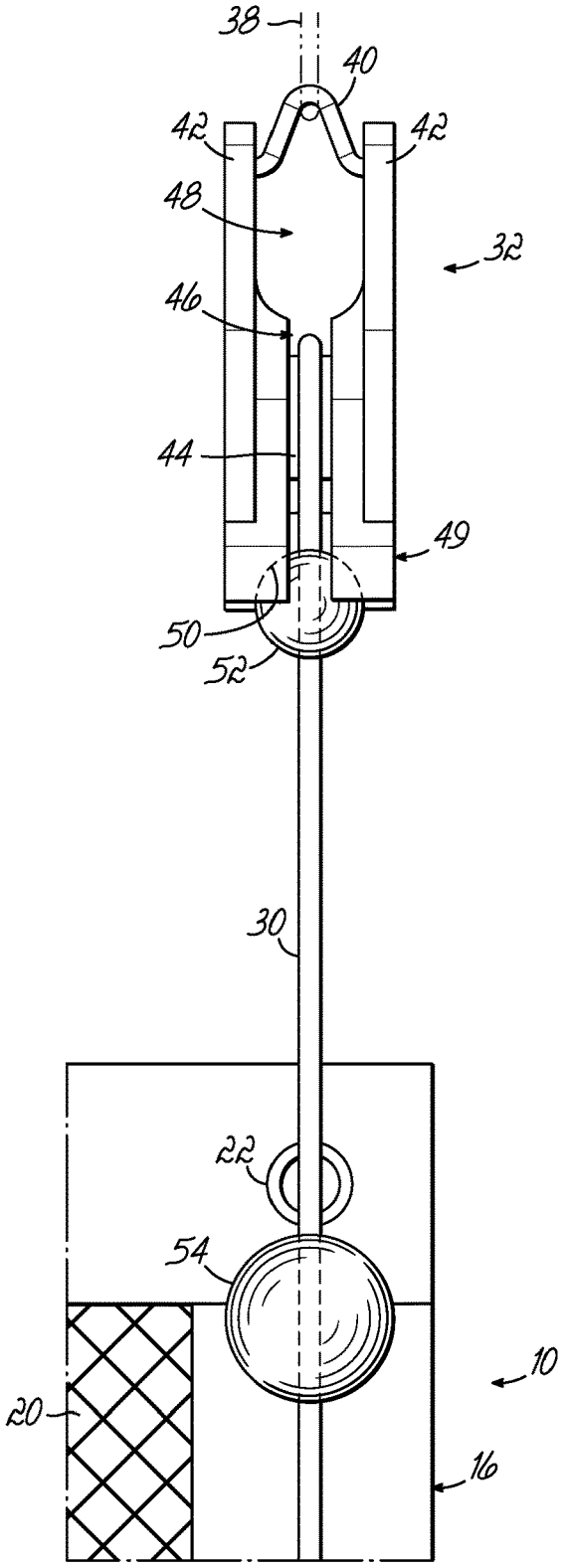
FIGS. 8A-8D are front elevational views of the pulley of FIGS. 6A-7D lowering the curtain.
Figure 8B:
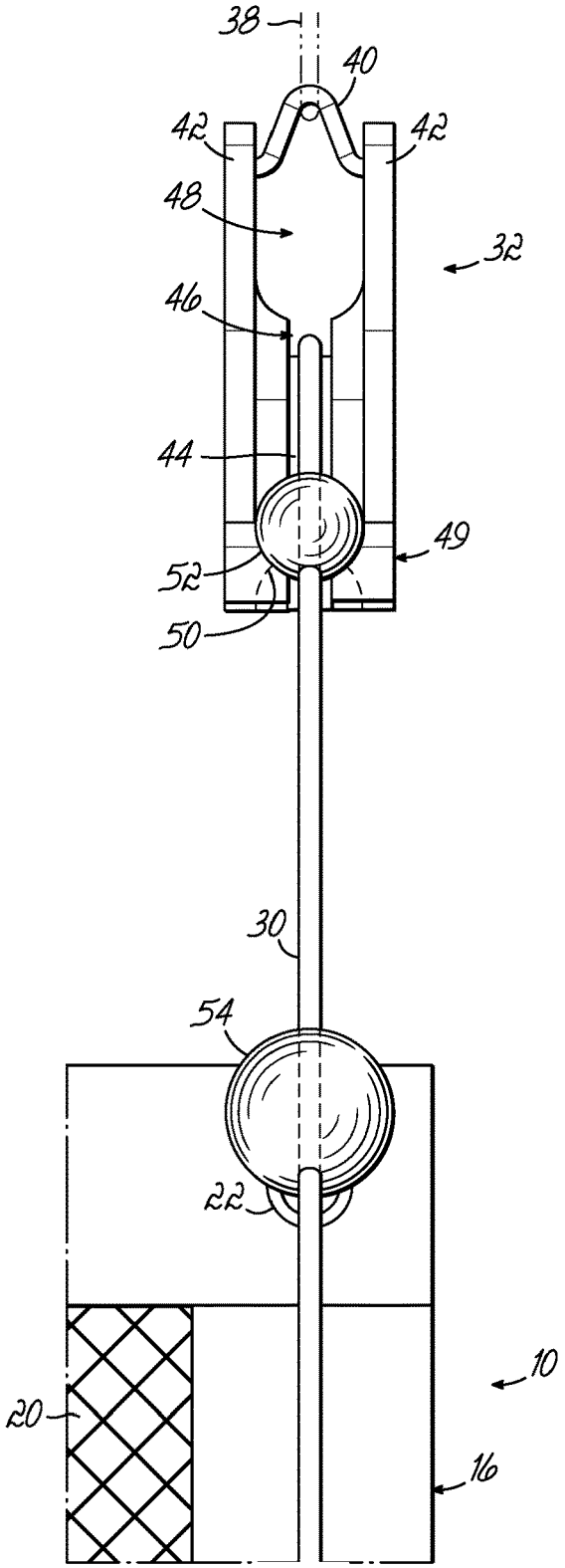
Figure 8C:
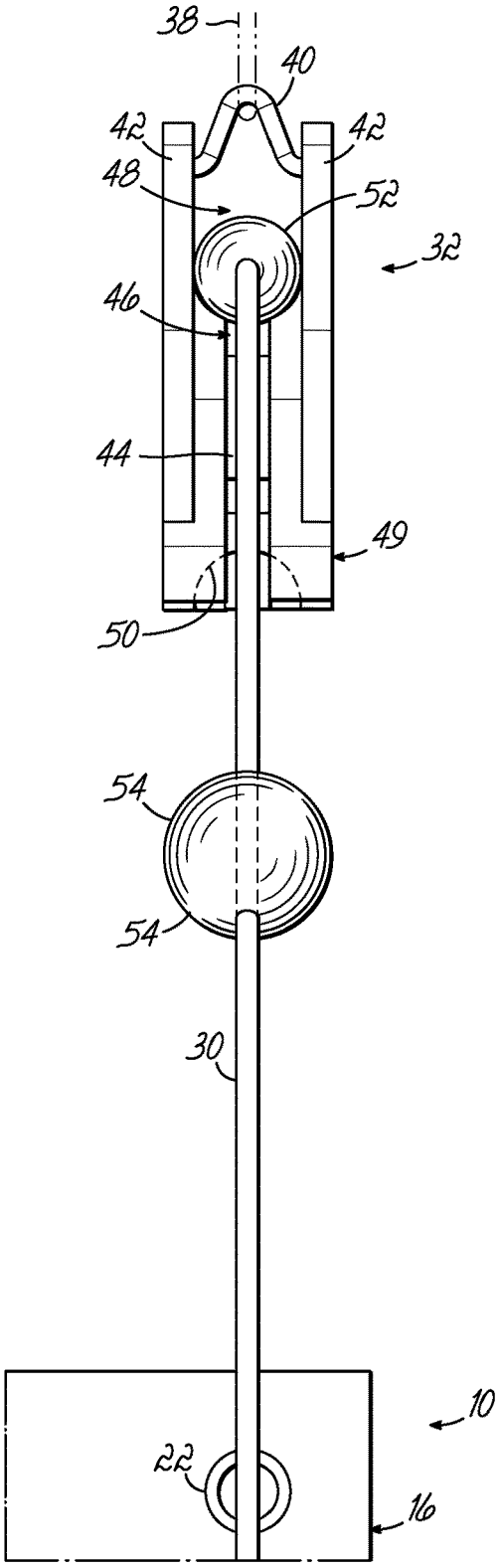
Figure 8D:
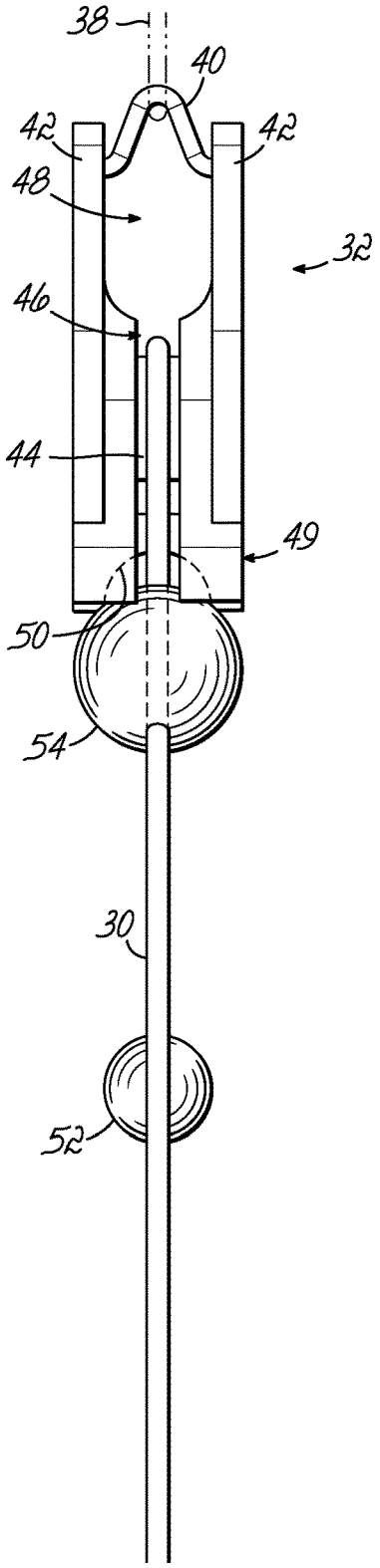

When positioned in the socket 50, either of the ball detents 52, 54 remains securely seated in the socket 50 due to the gravitational pull on the cord 30 by the curtain 10 until such time as the operator manipulates the cord 30 to unseat the ball detent 52 or 54 from the socket 50. When the upper ball detent 52 is seated in the socket 50, the curtain 10 is positioned in a raised position as shown in FIGS. 1-5 for normal use and operation. When the curtain 10 needs to be lowered from the raised position for replacement, cleaning or the like, an operator may gather multiple cords 30 as shown in FIG. 2 while standing on the floor 56 and without the need for a ladder, step stool, chair or the like. Alternatively, fewer than all of the cords 30 on the curtain 10 may be grasped by the operator. The cords 30 are then pulled slightly downward and away from the curtain 10 as shown by arrow A in FIGS. 6A and 7A. This unseats the ball detent 52 from the socket 50 as shown in FIGS. 6B and 7B. Once the ball detent 52 is unseated, the weight of the curtain 10 pulls the curtain downwardly and the cord 30 passes over and around the journal 44. The ball detent 52 then enters the upper raceway 48 as shown in FIGS. 6C, 7C and 8C. The upper raceway 48 is sized and configured to allow passage of the ball detent 52 therethrough. As the cord 30 and ball detent 52 pass through the pulley 32, the curtain 10 continues to lower from the raised position. Continued movement of the cord 30 through the pulley 32 in the direction of arrows B in FIGS. 7B and 7C moves the lower ball detent 54 toward the pulley 32 until the ball detent 54 reaches the socket 50 as seen in FIGS. 6D, 7D and 8D. When the ball detent 54 is seated in the socket 50, the curtain 10 is suspended at an accessible height which is lower than the operational height (see FIG. 1) to provide for convenient access, removal and/or attachment to/from the track 12 by an operator without the need for a ladder or the like.

When the ball detent 54 is seated in the socket 50, the curtain 10 is in a lowered accessible position or height making it accessible and convenient for an operator to unzip the zipper 24 and remove the bottom portion 14 from the top portion 16 for cleaning or replacement with a compatible bottom portion 14 by zipping it to the top portion 16. Generally, the distance between the ball detents 52, 54 on the cord 30 is the distance that the curtain 10 is lowered from the raised operational height or position to the lowered accessible position. Any adjustments to the distance between the ball detents 52, 54 will likewise change the distance that the curtain 10 is lowered. The curtain 10 remains vertically stationary at the lowered position when each ball detent 54 is seated in the socket 50 of the pulley 32. The entire curtain 10 may be removed via the curtain hooks 28 or just the bottom portion 14 via the zipper 24 when in the lowered accessible position.

Once the bottom portion 14 or the entire curtain 10 is replaced or cleaned the curtain 10 may be returned from the lowered accessible position to the raised operational position by the operator. While standing on the floor 56, the operator may pull the cord 30 to unseat the ball detent 54 from each of the associated sockets 50 simultaneously or via each pulley 32 serially. The operator then pulls each cord 30 over the respective journal 44 of each pulley 32 and the ball detent 52 through the upper raceway 48 of the associated pulley 32 until the curtain 10 is slightly higher than the raised position so that the ball detent 52 may clear the hub 49 and be positioned slightly below the socket 50. The operator may then manipulate the cords 30 individually or collectively to position the ball detents 52 just beneath the respective sockets 50 and then seat the ball detents 52 in the sockets 50. This once again secures the curtain 10 in the raised position for operation. The cords 30 may then be gathered for placement in the sleeves 36 as seen in FIG. 1.

Figure 9A:
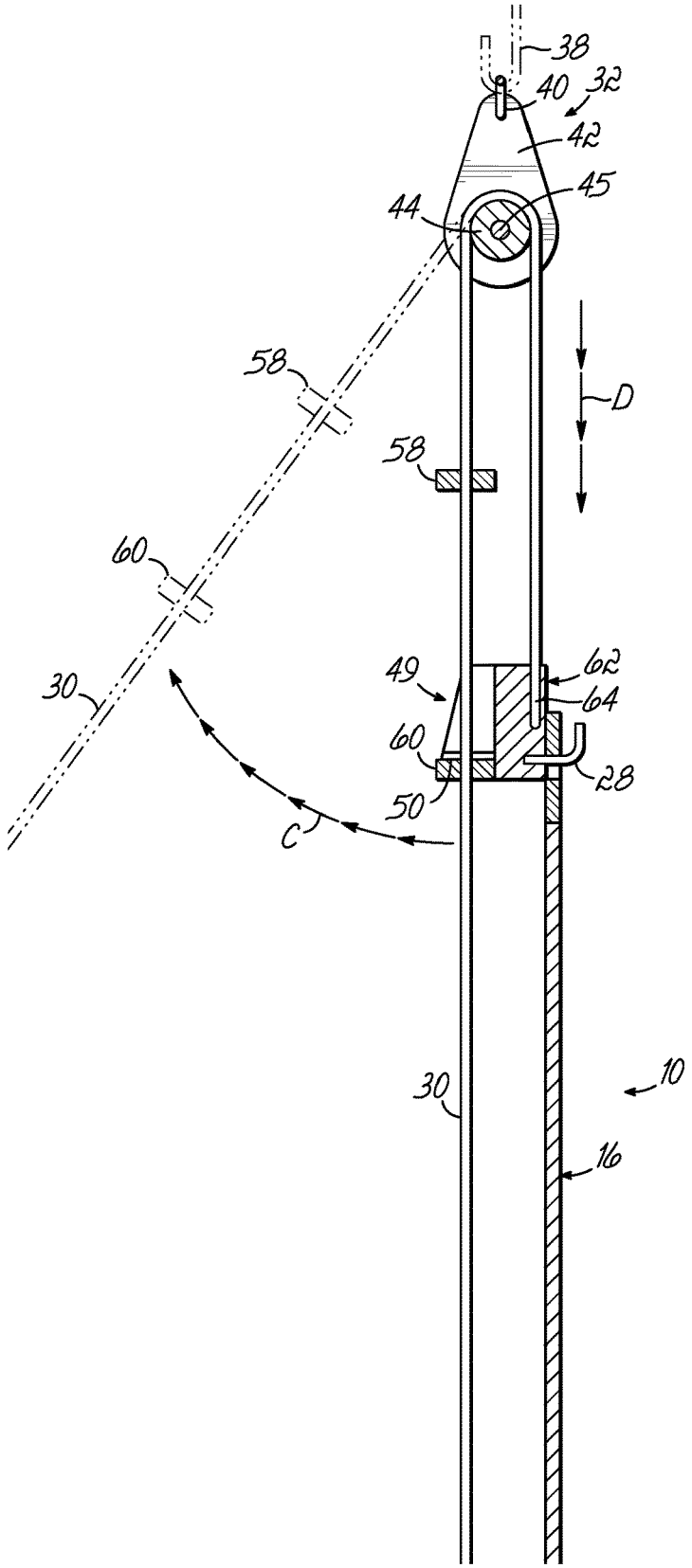
FIGS. 9A-9B are sequential cross-sectional side elevational views of a further embodiment of this invention lowering the curtain.
Figure 9B:
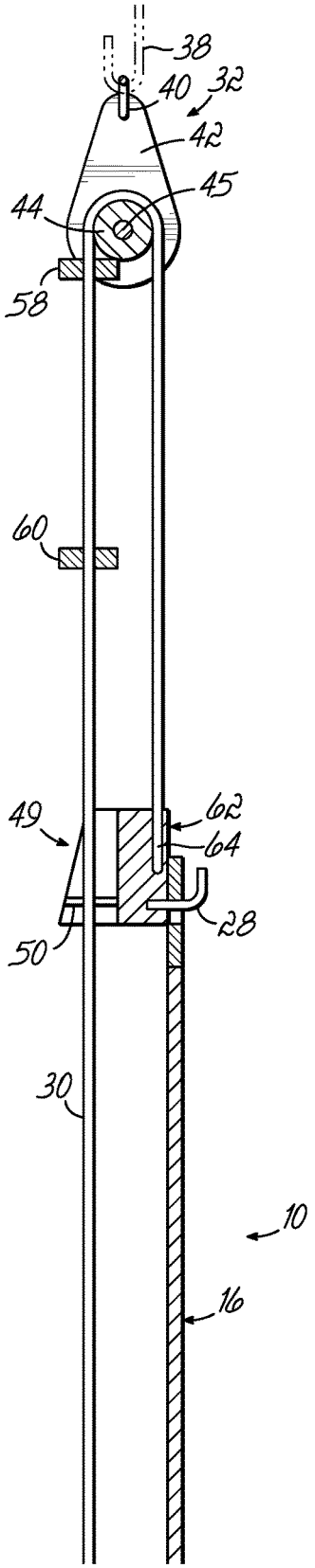

An alternative embodiment of this invention is shown in FIGS. 9A-9B with like elements from the prior embodiment(s) identified by like reference numerals. The detents on the cord 30 of this embodiment are block shaped detents 58, 60 with the lower block detent 60 seated in the socket 50 when the curtain 10 is in the raised position as shown in FIG. 9A. In this embodiment, the hub 49 is separate from the pulley 32 for each cord 30. The curtain hook 28 extends from a hub body 62 to suspend the curtain 10. A proximal end 64 of the cord 30 is secured to the hub body 62.

To release the curtain 10 from the raised position, the operator pulls the cords 30 collectively or in smaller groups in the direction of arrows C in FIG. 9A to release the block detent 60 from the socket 50 and lower the curtain 10 in direction of arrows D. The cord 30 passes over the journal 44 of the associated pulley 32 thereby lowering the curtain 10 toward the lowered position until the block detent 58 engages the pulley 32 as shown in FIG. 9B. At this point, the curtain 10 is in the lowered position and accessible for unzipping the bottom portion 14 or removing the entire curtain 10 and replacing it or cleaning it and reinstalling it. The curtain 10 can then be returned to the raised position by pulling one or more cords 30 and releasing the block detent 58 from the pulley 30 and engaging the block detent 60 with the socket 50 in the hub.

These foregoing embodiments of the invention are exemplary only and in no manner should be viewed as exhaustive or limiting on the scope of this invention. Alternative numbers of components, method steps, materials, parameters, arrangements and other aspects may be utilized within the scope of this invention.

From the above disclosure of the general principles of this invention and the preceding detailed description of at least one embodiment, those skilled in the art will readily comprehend the various modifications to which this invention is susceptible. Therefore, we desire to be limited only by the scope of the following claims and equivalents thereof.

We claim:

1. A curtain system comprising:

a curtain having an upper edge;

a track from which the curtain is suspended, wherein the track is configured to guide movement of the curtain;

a plurality of rigs each coupled to the track and being configured for movement with the curtain along the track, wherein each of the plurality of rigs comprises a respective pulley; and a plurality of cords each coupled to the curtain and a respective one of the plurality of rigs; wherein the plurality of cords suspends the curtain at an operational height relative to the track; and each of the plurality of cords is adjustable relative to a respective one of the plurality of rigs to facilitate lowering of the curtain from the operational height to an accessible height; and the accessible height is lower than the operational height and facilitates selective removal and attachment of the curtain relative to the track.

2. The curtain system of claim 1 wherein a first end of each of the plurality of cords is configured for selective attachment to and removal from the upper edge of the curtain.

3. The curtain system of claim 1 wherein each of the plurality of rigs further comprises:

a respective hub adjacent to the upper edge of the curtain; wherein each of the pulleys is adjacent to the track; and a position of each of the pulleys relative to the respective hub to and between the operational height and the accessible height is configured to be adjusted by movement of an associated one of the plurality of cords.

4. The curtain system of claim 3 further comprising:

a plurality of first detents each coupled to a respective one of the plurality of cords and configured to selectively secure the respective cord relative to an associated one of the respective pulleys with the curtain at the operational height.

5. The curtain system of claim 4 further comprising:

a plurality of second detents each coupled to a respective one of the plurality of cords and configured to selectively secure the respective cord relative to an associated one of the respective hubs with the curtain at the accessible height.

6. The curtain system of claim 1 wherein the curtain further comprises:

a top portion;

a bottom portion; and a zipper selectively joining and separating the bottom portion to and from the top portion.

7. A curtain system comprising:

a curtain having an upper edge;

a track from which the curtain is suspended, wherein the track is configured to guide movement of the curtain;

a plurality of rigs each coupled to the track and being configured for movement with the curtain along the track;

a plurality of cords each coupled to the curtain and a respective one of the plurality of rigs, wherein the plurality of cords suspends the curtain at an operational height relative to the track, wherein each of the plurality of cords is adjustable relative to a respective one of the plurality of rigs to facilitate lowering of the curtain from the operational height to an accessible height, and wherein the accessible height is lower than the operational height and facilitates selective removal and attachment of the curtain relative to the track; and a plurality of first detents each coupled to a respective one of the plurality of cords and configured to selectively secure the respective cord relative to a respective one of the plurality of rigs with the curtain at the operational height.

8. The curtain system of claim 7 further comprising:

a plurality of second detents each coupled to a respective one of the plurality of cords and configured to selectively secure the respective cord relative to a respective one of the plurality of rigs with the curtain at the accessible height.

9. The curtain system of claim 8 further comprising:

a respective socket in each of the plurality of rigs and configured to receive therein the associated first detent when the curtain is at the operational height and the associated second detent when the curtain is at the accessible height.

10. A curtain system of claim 1 comprising:

a curtain having an upper edge;

a track from which the curtain is suspended, wherein the track is configured to guide movement of the curtain;

a plurality of rigs each coupled to the track and being configured for movement with the curtain along the track, wherein each of the plurality of rigs comprises a first raceway and a second raceway; and a plurality of cords each coupled to the curtain and a respective one of the plurality of rigs; wherein the plurality of cords suspends the curtain at an operational height relative to the track;

each of the plurality of cords is adjustable relative to a respective one of the plurality of rigs to facilitate lowering of the curtain from the operational height to an accessible height;

the accessible height is lower than the operational height and facilitates selective removal and attachment of the curtain relative to the track;

the first raceway is sized and configured for an associated one of the plurality of cords to pass therethrough; and the second raceway is sized and configured for an associated first detent to pass therethrough; and wherein the first raceway is sized and configured to inhibit the associated first detent from passing therethrough.

11. A curtain system comprising:

a curtain having an upper edge;

a track from which the curtain is suspended, wherein the track is configured to guide movement of the curtain;

a plurality of rigs each coupled to the track and being configured for movement with the curtain along the track;

a plurality of cords each coupled to the curtain and a respective one of the plurality of rigs; and a pocket configured to retain a free end of at least some of the plurality of cords; wherein the plurality of cords suspends the curtain at an operational height relative to the track;

each of the plurality of cords is adjustable relative to a respective one of the plurality of rigs to facilitate lowering of the curtain from the operational height to an accessible height; and the accessible height is lower than the operational height and facilitates selective removal and attachment of the curtain relative to the track.

12. A curtain system comprising:

a curtain having an upper edge;

a track from which the curtain is suspended to guide movement of the curtain;

a plurality of pulleys each coupled to the track for movement with the curtain along the track;

a plurality of cords each coupled to the curtain and one of the plurality of pulleys;

wherein the plurality of cords suspend the curtain at an operational height relative to the track and each of the plurality of cords is adjustable relative to the associated pulley to lower the curtain to an accessible height lower than the operational height for selective removal and attachment of the curtain;

a plurality of first detents each coupled to a respective one of the plurality of cords to selectively secure the respective cord relative to the associated pulley with the curtain at the operational height;

a plurality of second detents each coupled to a respective one of the plurality of cords to selectively secure the respective cord relative to the associated pulley with the curtain at the accessible height;

a socket in each of the plurality of pulleys to receive therein the associated second detent when the curtain is at the accessible height.

13. The curtain system of claim 12 wherein a first end of each of the plurality of cords is configured to be selectively attached and removed from the upper edge of the curtain.

14. The curtain system of claim 12 wherein each of the plurality of pulleys comprises:

a first raceway sized and configured for the associated cord to pass through the associated pulley; and a second raceway sized and configured for the associated first detent to pass through the associated pulley;

wherein the first raceway is sized and configured to inhibit the first detent from passing therethrough.

15. The curtain system of claim 12 further comprising:

a pocket on the curtain to retain a free end of at least some of the plurality of cords.

16. The curtain system of claim 12 wherein the curtain further comprises:

a top portion;

a bottom portion; and a zipper selectively joining and separating the bottom portion to and from the top portion.

* * * * *